United States Patent [19]

Wynne

[11] 4,154,974

[45] May 15, 1979

[54] CLAMP FOR ARC FURNACE ELECTRODE

[75] Inventor: Peter J. Wynne, Pittsburgh, Pa.

[73] Assignee: Lectromelt Corporation, Pittsburgh, Pa.

[21] Appl. No.: 833,716

[22] Filed: Sep. 16, 1977

[51] Int. Cl.[2] ..... H05B 7/102

[52] U.S. Cl. ..... 13/16

[58] Field of Search ..... 13/14–17

[56] References Cited

U.S. PATENT DOCUMENTS 1,737,890 12/1929 Noichl et al. ..... 13/16

FOREIGN PATENT DOCUMENTS 262481 12/1927 United Kingdom ..... 13/16

*Primary Examiner*—R. N. Envall, Jr.

*Attorney, Agent, or Firm*—Fred Wiviott

[57] ABSTRACT

An arc furnace electrode is suspended by means of a clamp assembly which includes contact shoes adapted to bear against the surface of the electrode. The contact shoes are pivotally mounted adjacent their upper ends and force producing means independent of the shoe support engages each contact shoe for forcing the same into high pressure engagement with the electrode.

4 Claims, 5 Drawing Figures

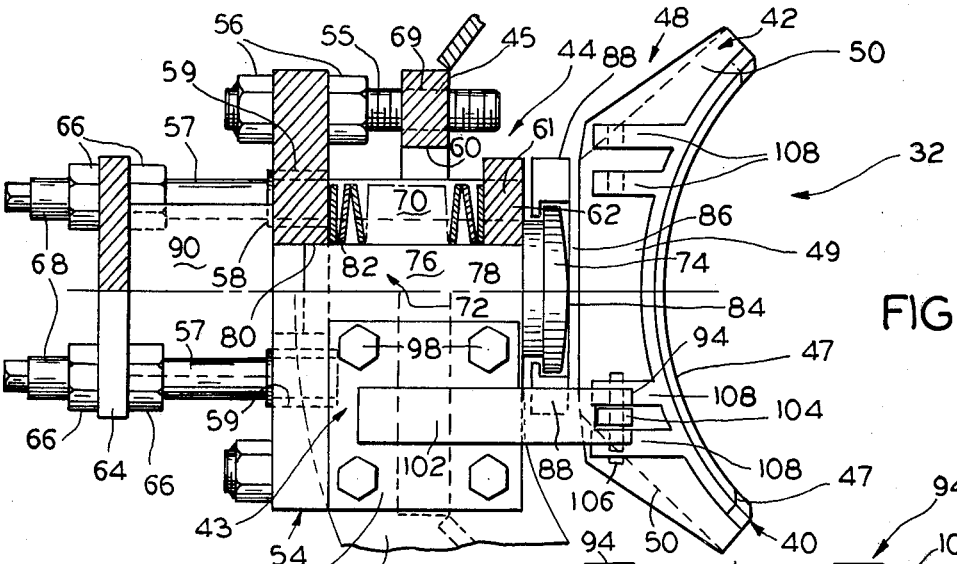
FIG.3
FIG.5
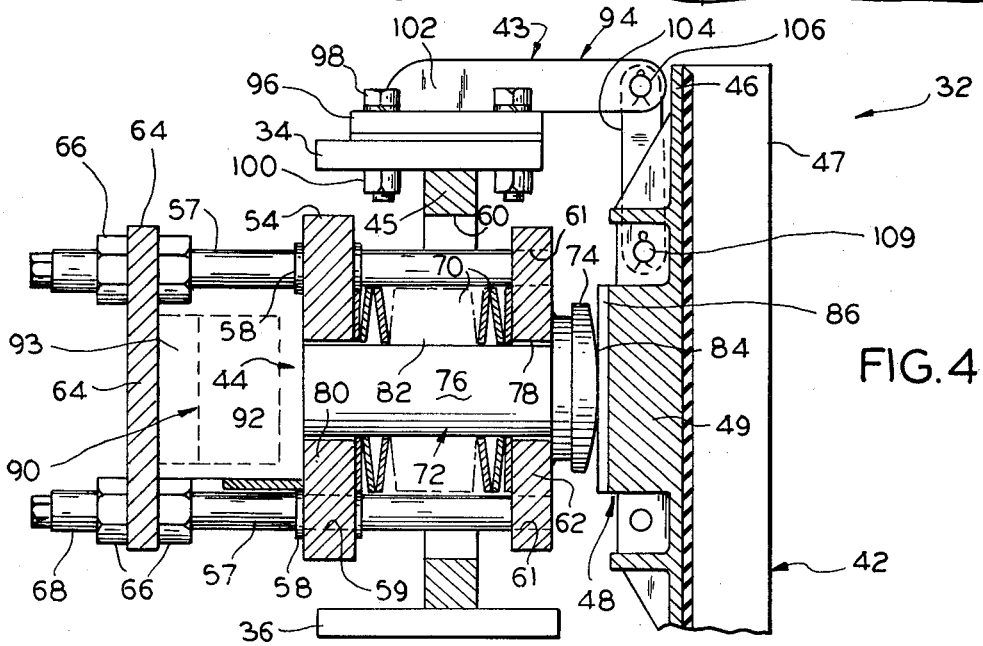
FIG.4

CLAMP FOR ARC FURNACE ELECTRODE

BACKGROUND OF THE INVENTION

This invention relates to electric arc furnace electrode supports and more particularly to an electrode clamp.

Electric arc smelting furnaces are generally provided with electrode holders suspended from a positioning assembly for holding and positioning an electrode relative to the furnace charge as well as for slipping the electrode as the lower end is consumed. The electrode clamp comprises a generally cylindrical member having a bore for slidably receiving an electrode and one or more contact shoes which grip the electrode. The transfer of current to the electrode may be from any suitable electrical connection.

In prior art electrode support apparatus, the contact shoes are generally supported on the holder for horizontal sliding movement and are coupled to force producing means which urge the shoes into engagement with the electrode. Because of the large vertical load exerted by the electrode on the contact shoe, substantial frictional forces are created in the horizontal support and in the force producing means which urges the contact shoe against the electrode. Also, contact shoes which are supported in this manner tended to be inhibited from fully seating against the electrode surface.

SUMMARY OF THE INVENTION

It is an object of the invention to provide a new and improved support and force producing assembly for electric arc furnace electrode contact shoes.

Another object of the invention is to provide an electrode clamp assembly wherein frictional forces are minimized in the contact shoe force producing mechanism.

Another object of the invention is to provide a clamp for electric arc furnace electrodes having a contact shoe which is relatively freely movable into engagement with the electrode surface.

These and other objects and advantages of the present invention will become more apparent from the detailed description thereof taken with the accompanying drawings.

BRIEF DESCRIPTION OF THE DRAWINGS

FIG. 3 is a view taken along lines 3—3 of FIG. 1 with parts broken away;

FIG. 4 is a view taken along lines 4—4 of FIG. 3; and

FIG. 5 is a view taken along lines 5—5 of FIG. 4.

DETAILED DESCRIPTION OF THE PREFERRED EMBODIMENT

Figure 1:
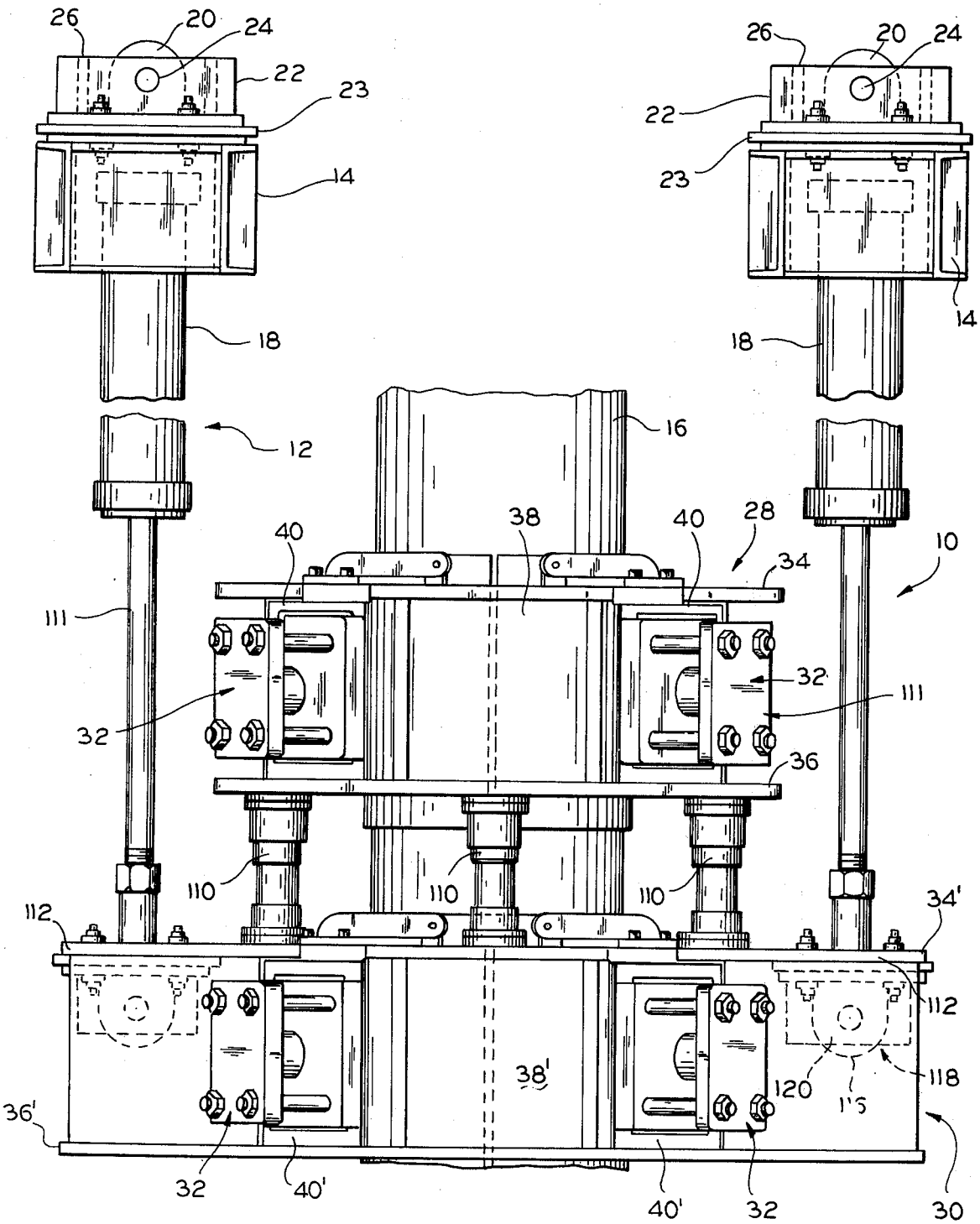
FIG. 1 is a side elevational view of an electrode holder embodying the present invention.

An electrode holder assembly 10 with which the contact shoe assemblies of the present invention are usable is suspended by a positioning assembly 12 fron support frames 14 positioned above the furnace (not shown). As will be discussed more fully below, the holder 10 is constructed and arranged for gripping an electrode 16 so that the same may be moved vertically through a suitable opening in a furnace roof (not shown) for advancement and retraction relative to the furnace charge.

The electrode positioning mechanism 12 is well known in the art and will not be discussed in detail. It will be sufficient for purposes of understanding the present invention to state that the assembly 12 includes a pair of positioning cylinders 18 pivotally mounted at their upper ends on the support frame 14 and at their lower ends to the holder assembly 10.

During normal furnace operation, the support cylinders 18 will be operated to elevate and depress the electrode 16 relative to the furnace charge and to perform electrode slipping operations as will be described below. While hydraulic cylinders 18 are shown to be employed for vertical movement of the electrode 16, those skilled in the art will appreciate that any suitable elevating and lowering mechanism, such as cables and drums, may also be employed.

In the illustrated embodiment, the upper end of each cylinder 18 is provided with an eye 20 which is pivotally supported on a bracket assembly 22 having a base plate 23 suitably affixed to support beam 14. The eye 22 extends upwardly through a suitable opening in support plate 23 for pivotally engaging a pivot pin 24 which extends through eye 20 and a pair of vertical brackets 26 extending upwardly from plate 23.

Support assembly 10 includes upper and lower clamp assemblies 28 and 30 each of which includes a plurality of contact shoe assemblies 32 according to the present invention. The upper clamp assembly 24 includes upper and lower flanges 34 and 36 which are interconnected by a plurality of side plates 38 and 40 which extend therebetween. As seen more particularly in FIG. 2, side plates 38 and 40 are arranged alternately and there are four of each. Mounted on each of the side plates 40 is one of the clamp shoe assemblies 32. While four contact shoe assemblies 32 are shown, it will be appreciated that any suitable number may be employed.

The contact shoe assemblies 32 according to the present invention are identical and accordingly, only one will be discussed for the sake of brevity. Specifically, each assembly 32 is shown more particularly in FIGS. 3, 4 and 5 to include a contact shoe 42 which is pivotally supported on a contact shoe hanger assembly 43 secured to top plate 34. Contact shoe 42 is pivotally mounted for movement toward and away from the electrode 16 by means under the influence of a pressure assembly 44 which is fixedly supported on a plate 45 extending between flanges 34 and 36. As will be discussed more fully below, substantially the entire portion of the weight of the electrode acting on contact shoe 42 is transferred to the hanger assembly 43 and the latter is borne by the pressure assembly 44.

The contact shoe 42 includes a face plate portion 46 having a front face 47 formed of a rubber or rubber-like material and which is a cylindrical section for engaging the generally cylindrical section for engaging the generally cylindrical surface of electrode 16. On the opposite side of the face plate portion 46 is a shaped force transmitting portion 48 which includes a generally rectangular, centrally located body 49 and a pair of wing portions 50 which extend laterally from the body 49 to the edges of the plate portion 46. The pressure assembly 44 includes an octagonal cylinder retaining plate 54 which in turn is affixed to support plate 45 by means of threaded studs 55 and bolts 56. The pressure assembly 44 is mounted on plate 54 by means of four rods 57 slidably extending through bushing 58 secured in suitable spaced apart apertures 59 formed generally at the corners of plate 54. Rods 57 extend forwardly from plate 54 and through a window 60 in plate 52 where the ends thereof are threaded for being received in internally threaded apertures 61 formed in spaced apart relation and generally at the corners of a generally rectangular spring retaining plate 62. The opposite ends of rods 57 are also threaded so that a rectangular cylinder retaining plate 64 may be adjustably secured to rods 57 by means of nuts 66. The degree of adjustment of nuts 66 is limited by stop sleeve 68 secured to the ends of rods 57. Also, studs 55 are received within threaded openings 69 in plate 45 so that the distance between plates 45 and 54 will also be adjusted.

It will be appreciated from the foregoing that after plate 64 has been positioned by nuts 66, the distance between plates 62 and 64 will be fixed relative to each other but that the gap between each plate and the opposite faces of plate 54 may be modified as a result of the sliding connection between rods 57 and plate 54. In addition, the plates 54, 62 and 62 are arranged in a parallel relation with the plates 62 and 64 disposed on the opposite sides of plate 54.

Disposed between plates 54 and 62 are a plurality of disc-shaped spring washers 70 which are arranged generally coaxial relative to a line perpendicular to plates 62 and 54. In addition, a pressure pin 72 has a head 74 affixed to the front face of plate 62 and a stem 76 extending rearwardly from head 74 and through aligned apertures 78 and 80 in plates 62 and 54 and correspondingly sized and aligned apertures 82 in washers 70. The front face 84 of pin head 74 is convex and generally defines a spherical section for engaging a pressure pad 86 affixed to the face of contact shoe body 42. A pair of pin retaining blocks 88 are affixed to the pressure pad 86 and on the opposite sides of the enlarged end of pin 74 so that the same is retained adjacent pressure pad 86.

Located between the plates 54 and 64 is a hydraulic jack 90 consisting of a cylinder 92 which bears against plate 54 and a piston 94 which bears against plate 64.

The hanger assembly 43 includes a pair of hangers 94 mounted on the top flange 34 and in spaced apart relation above and on the opposite sides of the axis of pin 72. The hangers 94 are identical and each includes a mounting plate 96 suitably affixed to plate 46 by bolts 98 and nuts 100. Affixed to the upper surface of each plate 96 and extending forwardly therefrom toward the contact shoe 46 is an elongate hanger member 102. The end of each member 102 is forked for embracing a downwardly extending link 104. A pin 106 extends through aligned openings in each member 102 and link 104 to provide a pivotal connection. Similarly, pairs of projecting fingers 108 extend outwardly from the rear face of contact shoe 46 for receiving the lower ends of links 104 and for being pivotally connected thereto by pins 109 which extend through aligned openings in each member.

From the foregoing, it will be appreciated that the spring washers 70 when compressed will tend to move plate 62 toward the right as viewed in FIGS. 3 and 4 to provide high pressure engagement between the pin head surface 84 and the pressure pad 86. This tends to move the contact shoe face 47 into high frictional engagement with the electrode 16. Because the contact shoe 46 is not physically connected to the pressure pin 74, but is rather independently pivotally supported from the member 102 by links 104 and pins 106 and 108, the contact shoe 46 can move into close conformity with the cylindrical surface of electrode 16. Also, because the support for the contact shoe is independent of the force producing apparatus, there are no high frictional support forces which must be overcome by the pressure producing assembly in moving the contact shoe into high frictional engagement with the electrode. Further, since the plates 62 and 64 are held in a fixed relation by pins 57, movement of plate 62 toward the right under the influence of spring 70 will also tend to move the plate 64 in the same direction.

The holder assembly 30 includes a top flange 34' and a bottom flange 36' and alternating interconnecting plates 38' and 40'. The contact shoe assemblies 32' of holder 30 are mounted on plates 40' in the same manner as discussed with respect to contact shoe assemblies 32. The top flange 34' of the lower holder assembly 30 is connected to the lower flange 36 of the upper assembly 28 by a plurality of spaced apart hydraulic cylinders 110. It will be appreciated that when cylinders 110 are pressurized, they will exert a force tending to elevate holder 28 relative to holder 30.

Figure 2:
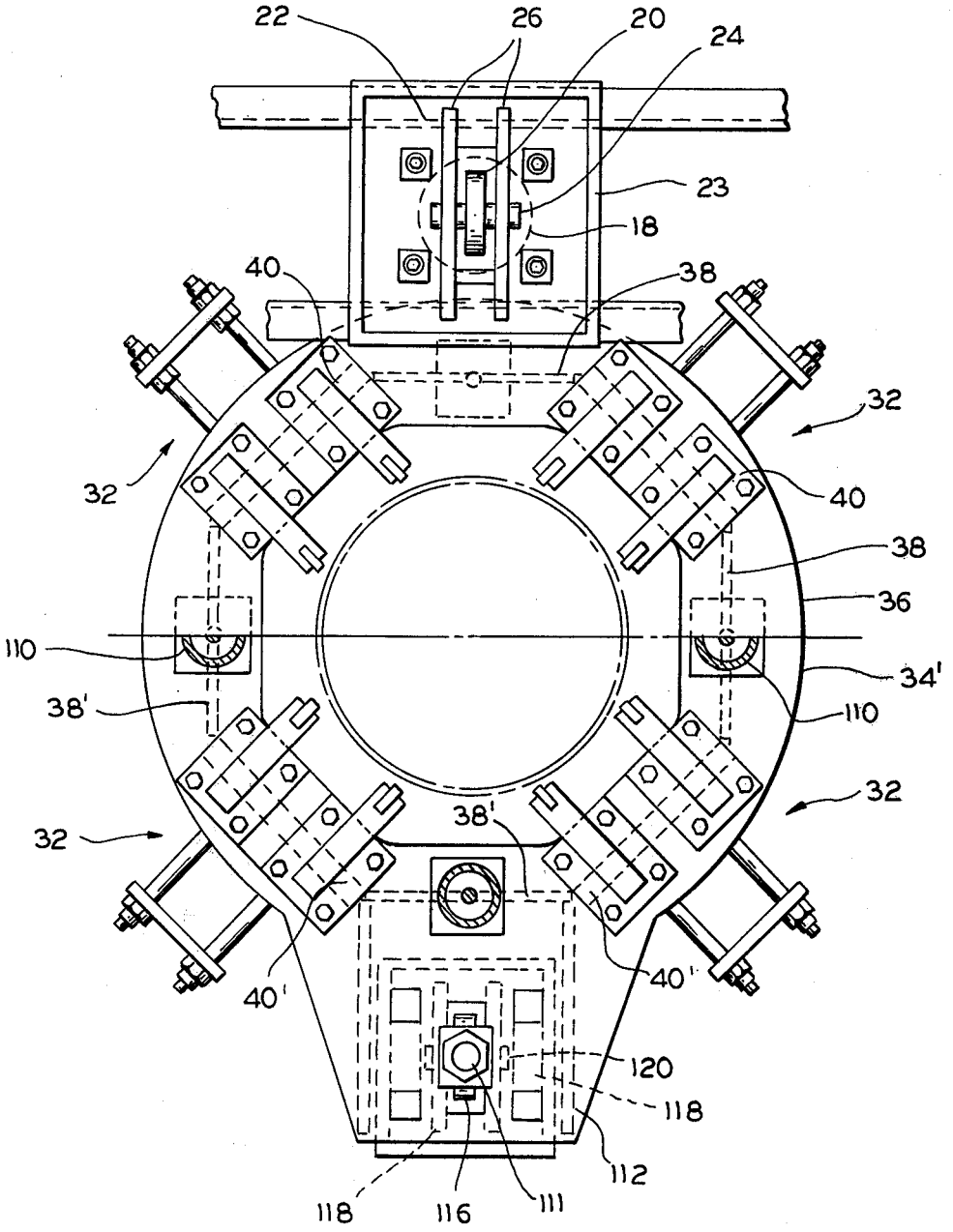
FIG. 2 is a top plan view of the electrode holder of FIG. 1.

As seen in FIG. 2, each of the pistons 18 has a piston rod 111 extending downwardly therefrom and the lower end of each is pivotally connected to the top flange 34' of the lower holder 30. Specifically, each of the flanges 34' has an outwardly extending wing 112 having a rectangular opening 114 for receiving an eye 116 affixed to the lower end of piston rod 110. A bracket assembly 118 substantially identical to the bracket 22 is affixed to the lower surface of wing 112 so that eye 116 may be affixed by means of pin 120. The hydraulic jack 90 may be a single acting device which when pressurized, moves the plate 64 toward the left relative to the fixed plate 54. Because the plates 64 and 62 are coupled through the agency of rods 57, such movement of plate 64 also moves the plate 62 toward the left as viewed in FIGS. 3 and 4. This movement of plate 62 in opposition to the springs 70 reduces the high frictional engagement between the pin head 74 and the pressure pad 86 thereby reducing the frictional force between contact shoe 46 and electrode 16 to permit relative movement therebetween. When it is desired to reestablish the clamping force, the pressure in hydraulic jack 90 is relieved whereby spring washers 70 may reestablish the clamping engagement with the electrode 16.

Electrodes employed in smelting applications commonly consist of cylindrical graphite sections which are connected in an endwise manner. As the lower end of the electrode 16 is consumed or broken away, the cylinders 18 progressively feed the electrode toward the furnace charge to maintain the proper spacing therebetween. When the cylinders approach their lower limit, it is necessary to move the assembly 10 upwardly relative to the electrode 16 and to add another section to its upper end. This procedure is called "slipping the electrode." When it is desired to slip the electrode 13, individual contact shoes 46 of the upper clamp assembly 28 are released from engagement with electrode 13 while those of the lower clamp assembly 30 are maintained to support the electrode. The cylinders 110 are pressurized to elevate clamp assembly 28 relative to the lower assembly 30. The contact shoes 46 of upper clamp assembly 28 are then re-engaged with the electrode 13. Also, pressure is relieved in cylinders 110 and cylinders 18 are actuated to retract piston rods 111 thereby elevating the lower clamp assembly 30 relative to the electrode 13 and returning it to its original spacing relative to the clamp assembly 14. The contact show assemblies 46 of lower clamp assembly 30 are then actuated so that both clamp assemblies now engage the electrode 13. Normal operation of the positioning assembly 12 may then be provided to feed the electrode toward the furnace.

While only a single embodiment of the invention has been illustrated and described, it is intended to be limited only by the scope of the appended claims.

I claim:

1. An electrode holder including a plurality of spaced apart clamps each having a clamping surface for engaging the surface of an electrode to support the same, said clamping surfaces being contoured complimentary to a portion of the electrode surface, support means mounted on said electrode holder, each clamp being pivotally mounted on said support means for movement toward and away from the electrode, a plurality of elongate pressure members, each member being engageable at one end with a different one of said clamps but being disconnected therefrom, a pressure assembly for each member, each pressure assembly including a first support portion fixedly mounted on the electrode holder and second and third support portions, a coupler connecting each associated second and third support portions and being slidably mounted on the first support portion, the second and third support portions of each pressure assembly being disposed on the opposite sides of their associated first support portion and being unsupported except by said coupler, said members each being engaged by their respective second support portions, hydraulic means disposed between each first and third support portions and spring means being disposed between the first and second support portions of each pressure assembly, said pressure members being slidably mounted longitudinally on said first and second support portions for being urged by the second support portion under the influence of the spring means and into engagement with its associated clamp.

2. The electrode holder set forth in claim 1 wherein said support means includes hanger means mounted on said electrode holder, and pivot means pivotally connecting each clamp to said hanger means, a plurality of link means each pivotally connected at one end to said hanger means and at its other end to one of said clamps, the pivotal axis of each said link means being normal to the direction in which its respective pressure assembly acts.

3. The electrode holder set forth in claim 2 wherein said hanger means is disposed generally above said clamp, said link means each being pivotally mounted at one end to said electrode hanger and each extending generally downwardly therefrom for being pivotally connected to its respective clamp at a point above the line of action of said pressure assembly.

4. The electrode holder set forth in claim 3 wherein said hanger means comprises pairs of hangers associated with each clamp, said link means comprising pairs of links, the links of each pair being pivotally connected at one end to one of said hangers and extending generally downwardly therefrom, the links of each pair being parallel and each being pivotally connected at its lower end to its associated clamp.

* * * * *